US008186826B2

(12) United States Patent
Sakano et al.

(10) Patent No.: US 8,186,826 B2
(45) Date of Patent: May 29, 2012

(54) INKJET RECORDING APPARATUS

(75) Inventors: Yuji Sakano, Toyota (JP); Kiyoshi Sugimoto, Kuwana (JP); Hideki Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 639 days.

(21) Appl. No.: 12/390,151

(22) Filed: Feb. 20, 2009

(65) Prior Publication Data

US 2009/0219333 A1 Sep. 3, 2009

(30) Foreign Application Priority Data

Feb. 28, 2008 (JP) ..... 2008-047659

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS 6,725,776 B2 4/2004 Takata
7,384,122 B2 6/2008 Shimizu
7,427,131 B2 9/2008 Okamoto et al.
2005/0128276 A1* 6/2005 Yamada ..... 347/104
2007/0147875 A1 6/2007 Hattori

FOREIGN PATENT DOCUMENTS

| | | | |
|---|---|---|---|
| JP | H63-122544 | A | 5/1988 |
| JP | H05-169696 | A | 7/1993 |
| JP | 2001-337402 | A | 12/2001 |
| JP | 2002-108153 | A | 4/2002 |
| JP | 2004-136664 | A | 5/2004 |
| JP | 2006-043889 | A | 2/2006 |
| JP | 2006-069739 | A | 3/2006 |
| JP | 2006-103275 | A | 4/2006 |
| JP | 2006-273443 | A | 10/2006 |
| JP | 2006-315226 | A | 11/2006 |
| JP | 2007-169024 | A | 7/2007 |

OTHER PUBLICATIONS

Japanese Patent Office, Notification of Reasons for Refusal for Application No. 2008-047659, dated Jun. 15, 2010. (partial translation).
Japanese Patent Office, Notification of Reason for Refusal for Application No. 2008-047659, dated Aug. 31, 2010.

* cited by examiner

*Primary Examiner* — Jerry Rahll
(74) *Attorney, Agent, or Firm* — Baker Botts L.L.P.

(57) ABSTRACT

An inkjet recording apparatus is provided. The inkjet recording apparatus includes an inkjet head having a discharge surface in which discharge ports are formed for discharging ink; a moving mechanism that is configured to move the inkjet head and a recording medium relative to each other; and a capture unit that is configured to capture an extraneous substance, the capture unit disposed upstream of the inkjet head in a moving direction of the recording medium relative to the inkjet head, and disposed adjacent to the inkjet head.

15 Claims, 4 Drawing Sheets

INKJET RECORDING APPARATUS

CROSS REFERENCE TO RELATED APPLICATION

The present application claims priority from Japanese Patent Application No. 2008-047659, which was filed on Feb. 28, 2008, the disclosure of which is herein incorporated by reference in its entirety.

TECHNICAL FIELD

Apparatuses consistent with the present invention relate to an inkjet recording apparatus for recording an image on a recording medium by discharging ink onto the recording medium.

BACKGROUND

A known inkjet recording apparatus includes a transport belt for transporting a sheet and four in-line type inkjet heads for discharging inks onto a sheet transported thereto by the transport belt.

SUMMARY

In the inkjet recording apparatus, when a sheet is transported at high speed by the transport belt, an air flow is generated in the same direction as a transport direction of the sheet. As this occurs, the air flow so generated comes to strike a sidewall of the fixed inkjet head to there by generate an upward air flow along the side wall. Extraneous substances such as paper dust are blown upwards by the upward air flow so generated. There exists a possibility that the extraneous substances so blown upwards pass through a space around the inkjet head and move to the vicinity of a discharge surface of the inkjet head. Since nozzles for discharging ink are formed in the discharge surface, when extraneous substances stick to the vicinity of the nozzles, a spraying direction of ink discharged from the nozzles is interrupted, resulting in a reduction in printing accuracy. In addition, when extraneous substances enter inside the nozzles, ink cannot be discharged from the nozzles.

In addition, in a serial type inkjet recording apparatus in which an image is formed on a sheet by discharging ink on to the sheet by a moving inkjet head, when the inkjet head is moved, an upward air flow is generated along a downstream-side side wall of the inkjet head in a moving direction thereof to thereby blow upwards extraneous substances such as paper dust. As this occurs, extraneous substances so blown upwards come to stick to a discharge surface of the inkjet head for the same reason as described above.

Accordingly, a need has arisen for an inkjet recording apparatus which makes it difficult for extraneous substances to stick to a discharge surface of an inkjet head thereof.

According to an aspect of the invention, there is provided an inkjet recording apparatus comprising: an inkjet head having a discharge surface in which discharge ports are formed for discharging ink; a moving mechanism that is configured to move the inkjet head and a recording medium relative to each other; and a capture unit that is configured to capture an extraneous substance, the capture unit disposed upstream of the inkjet head in a moving direction of the recording medium relative to the inkjet head, and disposed adjacent to the inkjet head.

According to the inkjet recording apparatus of the aspect of the invention, since extraneous substances are captured upstream of the inkjet head by the capture unit, extraneous substances are made difficult to enter in the area lying in the vicinity of the discharge surface of the inkjet head, whereby extraneous substances are made difficult to stick to the discharge surface.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Hereinafter, an exemplary embodiment of the present invention will be described by reference to accompanying drawings.

Figure 1:
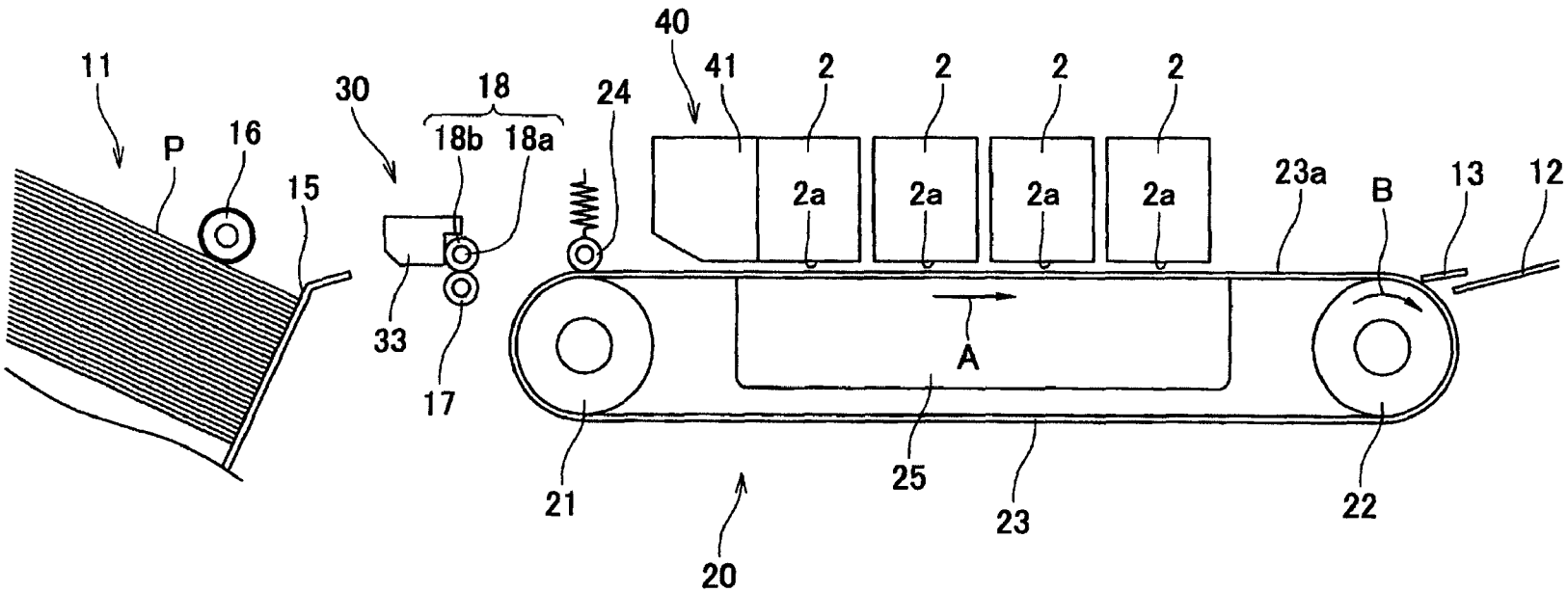
FIG. 1 is a schematic side view of an inkjet printer according to an exemplary embodiment of the present invention.
Figure 2A:
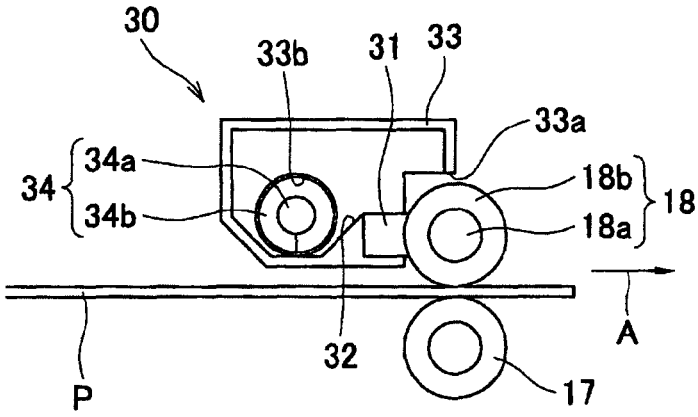
FIG. 2A is a vertical sectional view of the paper dust removal mechanism shown in FIG. 1.
Figure 2B:
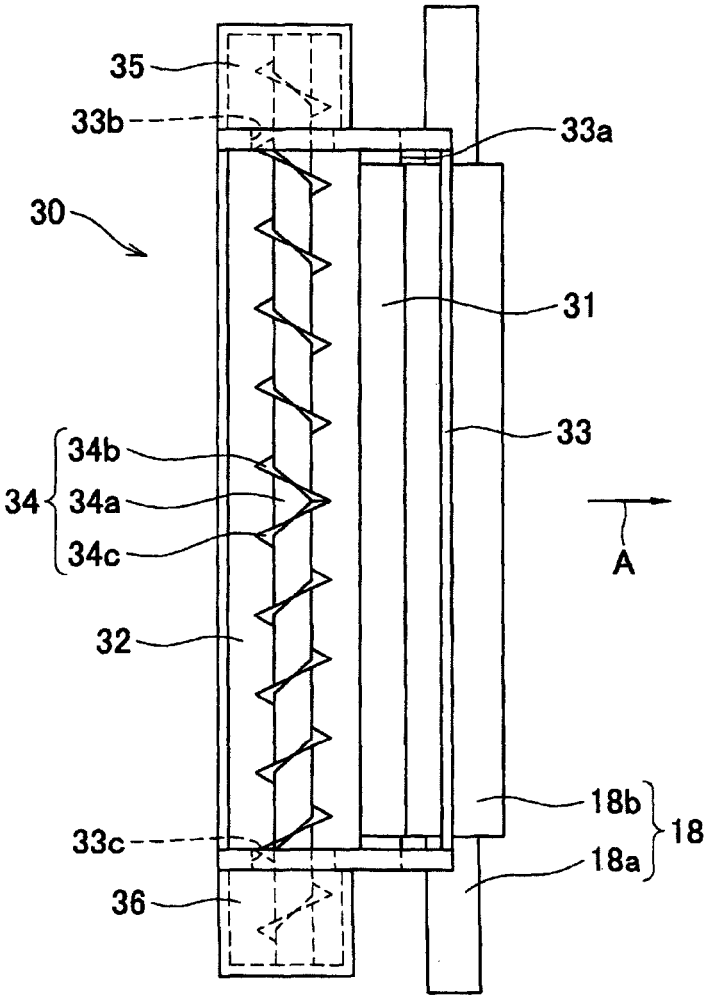
FIG. 2B is a horizontal sectional view of the paper dust removal mechanism shown in FIG. 1.
Figure 3A:
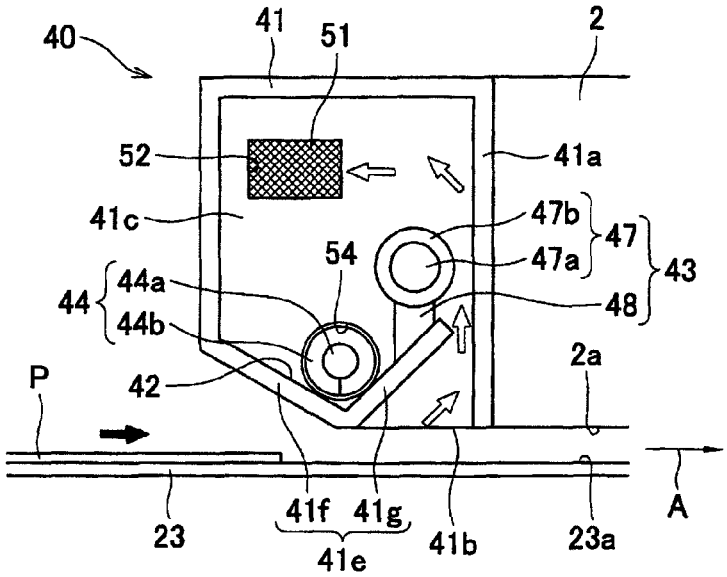
FIG. 3A is a vertical sectional view of the paper dust capture mechanism shown in FIG. 1.
Figure 3B:
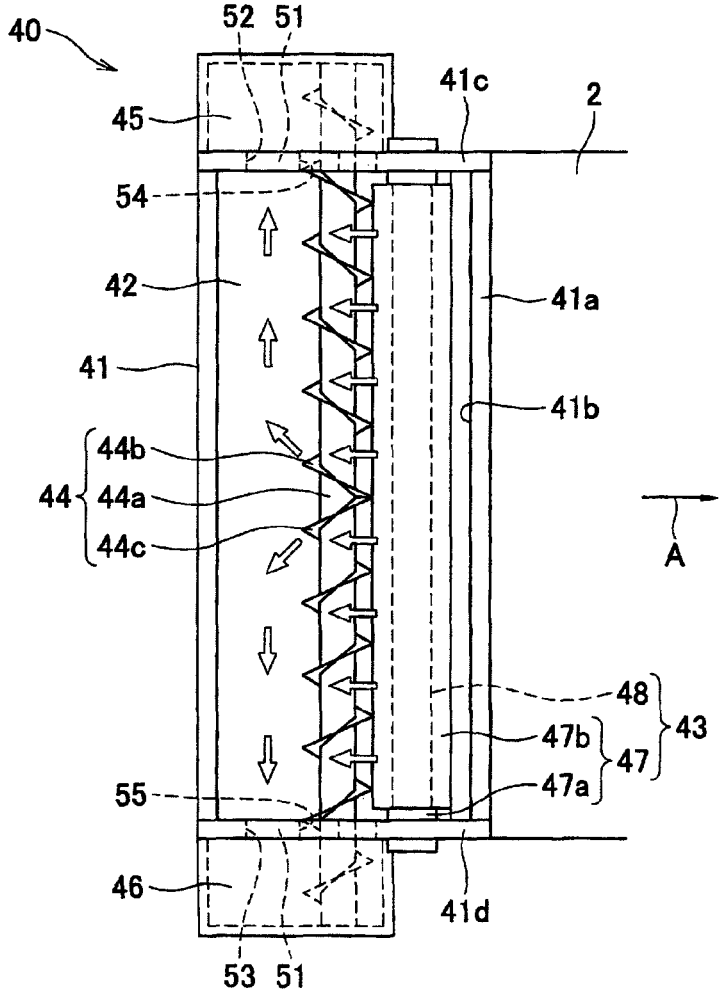
FIG. 3B is a horizontal sectional view of the paper dust capture mechanism shown in FIG. 1.

FIG. 1 is a schematic side view of an inkjet printer according to an exemplary embodiment of the present invention. FIG. 2 shows diagrams depicting a paper dust removal mechanism shown in FIG. 1, of which FIG. 2A is a vertical sectional view of the paper dust removal mechanism and FIG. 2B is a horizontal sectional view thereof. FIG. 3 shows diagrams depicting a paper dust capture mechanism shown in FIG. 1 and its vicinity, of which FIG. 3A is a vertical sectional view of the paper dust capture mechanism, and FIG. 3B is a horizontal sectional view of the paper dust capture mechanism.

An inkjet printer 1 is, as shown in FIG. 1, a color inkjet printer having four inkjet heads 2. This inkjet printer 1 includes a sheet feeding mechanism 11 which is provided at the left in FIG. 1 and a sheet discharging part 12 which is provided at the right in FIG. 1. A transport unit (a moving mechanism) 20, which is configured to transport a sheet P fed out of the sheet feeding mechanism 11 towards the sheet feeding part 12, that is, in a transport direction A, is provided between the sheet feeding mechanism 11 and the sheet discharging part 12.

The sheet feeding mechanism 11 has a sheet accommodation unit 15 for accommodating stacked sheets P and a feed roller 16 for feeding out a sheet P from the sheet accommodation unit 15. The feed roller 16 feeds out a top most sheet P of the stacked sheets P accommodated in the sheet accommodation unit 15 towards the transport unit 20.

A paper dust removal mechanism 30 is provided between the sheet feeding mechanism 11 and the transport unit 20 for removing paper dust sticking to a sheet P. As shown in FIG. 2, the paper dust removal mechanism 30 has a pair of delivering rollers 17, 18, a sponge member 31 which is disposed so as to contact an outer circumferential surface of the delivering roller 18, a box 33 having a paper duct holding portion 32 which holds paper dust removed by the sponge member 31, an auger member 34 which is disposed rotatably and is held on the paper dust holding portion 32 for transporting paper dust, and two paper dust storage portions 35, 36 which are fixed respectively to side walls of the box 33 for storing paper dust which has been transported thereto by the auger member 34. The paper dust storage portions 35, 36 have a substantially rectangular parallelepiped shape having a space in an interior thereof and are disposed in positions where they confront the auger member 34 in an axial direction of the auger member in FIG. 2B.

The pair of delivering rollers 17, 18 transports a sheet P fed out from the sheet feeding mechanism 11 to the transport unit 20 while holding the sheet P. The delivering roller 18 is made up of a metallic shaft 18*a* and a resin roller 18*b* having an easily chargeable surface such as a roller made from fluorine plastic or a roller whose surface is coated with fluorine, with the metallic shaft 18*a* covered by the resin roller 18*b*.

The sponge member 31 is made from a material such as urethane foam which facilitates charging of the delivering roller 18. In addition, the sponge member 31 is disposed upstream of the delivering roller 18 in the transport direction so as to press contact the delivering roller 18 from an opening 33*a* formed in the box 33. In this configuration, when the pair of delivering rollers 17, 18 rotates so as to transport a sheet P, an outer circumferential surface of the delivering roller 18 is charged by rubbing friction between the delivering roller 18 and the sponge member 31, so as to adsorb paper dust from the sheet P that is being transported. The paper dust adsorbed onto the delivering roller 18 is scraped off the delivering roller 18 by the sponge member 31 and is then accumulated at an upper portion of the sponge member 31. Then, when the accumulated amount of paper dust exceeds a predetermined amount, the paper dust so accumulated is made to flow down into the paper dust holding portion 32 which is disposed upstream of the sponge member 31 in the transport direction.

The auger member 34 has a shaft 34*a* and two spiral members 34*b*, 34*c* which are formed on an outer circumferential surface of the shaft 34*a*. The shaft 34*a* extends in a up-down direction in FIG. 2B so as to pass through holes 33*b*, 33*c* which are formed in side walls of the box 33 and is rotatably supported, respectively, on side walls of the paper dust storage portions 35, 36 at both ends thereof. The spiral member 34*b* extends from a center of the shaft 34*a* to an interior of the paper dust storage portion 35 which is disposed upwards in FIG. 2B after passing through the hole 33*b*, while the spiral member 34*c* extends from the center of the shaft 34*a* to an interior of the paper dust storage portion 36 which is disposed downwards in FIG. 2B after passing through the hole 33*c*. In addition, the two spiral members 34*b*, 34*c* are spiraled in an opposite direction to each other. By this configuration, when the shaft 34*a* rotates counterclockwise in FIG. 2A, the spiral member 34*b* transports paper dust held on the paper dust holding portion 32 to the interior of the paper dust storage portion 35, while the spiral member 34*c* transports paper dust held on the paper dust holding portion 32 to the interior of the paper dust storage portion 36.

As shown in FIG. 1, the transport unit 20 has a pair of belt rollers 21, 22, an endless transport belt 23 which is looped round both the rollers 21, 22 so as to extend therebetween, and a hold-down roller 24. An outer circumferential surface, that is, a transport surface 23*a* of the transport belt 23 is treated with silicone so as to impart adhesion thereto. The hold-down roller 24 is disposed in a position where it lies above the belt roller 21 across the transport belt 23. In addition, the hold-down roller 24 is pressed towards the transport surface 23*a* by an elastic member such as a spring so as to press a sheet P transported thereto by the pair of delivering rollers 17, 18 against the transport surface 23*a*.

By this configuration, the sheet P which is pressed against the transport surface 23*a* is transported in the transport direction A while being held onto the transport surface 23*a* by virtue of the adhesive force thereof. As this occurs, the belt roller 22 which lies downstream in the transport direction is imparted a driving force by a drive motor to rotate clockwise (in a direction indicated by an arrow B) in FIG. 1.

A separation member 13 is provided directly downstream of the transport unit 20 in the transport direction A. The separation member 13 is made to separate the sheet P which is held onto the transport surface 23*a* from the transport surface 23*a* so as to convey the sheet P towards the sheet discharging part 12 which lies on the right of the separation member 13 in FIG. 1.

A platen 25 having a substantially rectangular parallelepiped shape is disposed within an area surrounded by the transport belt 23 in a position where the platen 25 confronts the inkjet heads 2 so as to be brought into contact with an inner circumferential surface of the transport belt 23 which lies on an upper side of the platen 25, so as to support the transport belt 23.

The four inkjet heads 2 are aligned along the transport direction A so as to correspond to four colored inks (magenta, yellow, cyan, black). Namely, the inkjet printer 1 is of an in-line type. The inkjet head 2 has an elongate rectangular parallelepiped shape whose longitudinal direction extends in a direction which is at right angles to the transport direction A (a vertical direction to a surface of a sheet on which FIG. 1 is drawn). In addition, the inkjet head 2 has a laminated structure in which a flow path unit containing a pressure chamber in which an ink flow path is formed and an actuator for imparting pressure to ink in the pressure chamber are glued together, and ink is discharged from a number of nozzles formed in a discharge surface 2*a*.

The discharge surface 2*a* of the inkjet head 2 becomes parallel to the transport surface 23*a* of the transport belt 23 which confronts the inkjet head 2, and a sheet transport path is formed between these two confronting surfaces. In this configuration, when the sheet P transported by the transport belt 23 passes sequentially right below the four inkjet heads 2, inks of the respective colors are discharged towards an upper surface (a printing surface) of the sheet P from the nozzles of the inkjet heads 2 to thereby form a desired color image on the sheet P.

As shown in FIG. 1, a paper dust capture mechanism (a capture unit) 40 is provided between the inkjet head 2 which is situated upstreammost in the transport direction A and the hold-down roller 24 so as to be disposed adjacent to the inkjet head 2. As shown in FIG. 3, the paper dust capture mechanism 40 has a box 41 having a paper dust holding portion 42 for holding paper dust and disposed in such a state that its side wall 41*a* is in contact with a side wall of the inkjet head 2, an electrostatic adsorption mechanism 43 disposed in an interior of the box 41, an auger member 44 disposed rotatably for transporting paper dust held on the paper dust holding portion 42 and two paper dust storage portions 45, 46 fixed respectively to side walls 41*c*, 41*d* of the box 41 which confront each other in an up-down direction in FIG. 3B for storing therein paper dust transported thereto by the auger member 44. The paper dust storage portions 45, 46 each have a substantially rectangular parallelepiped shape having a space in an interior thereof and are disposed in positions where they confront the auger member 44 in the up-down direction in FIG. 3B.

The box 41 has a substantially rectangular parallelepiped shape and has almost the same vertical length or height as that of the inkjet head 2. In addition, the box 41 has almost the same length as that of the inkjet head 2 with respect to the up-down direction in FIG. 3B. As shown in FIG. 3A, a bottom wall 41*e* of the box 41 is made up of two inclined portions 41*f*, 41*g* which are formed into a V-shape, and an opening 41*b* is formed between an apex portion where these inclined portions 41*f*, 41*g* intersect each other and a lower end of the sidewall 41*a*. In addition, holes 52, 53 are formed respectively in the side plates 41*c*, 41*d* of the box 41, and filters 51 for capturing paper dust are disposed respectively in the holes 52, 53 so formed. In addition, the holes 52, 53 each establish a communication between an inside and an outside of the box 41.

In this configuration, when a sheet P is transported in the transport direction at high speed by the transport unit 20, as indicated by a moderately thick black arrow in FIG. 3A, an air flow is generated in a relative movement direction of the sheet P relative to the inkjet heads 2 which is a direction directed from a leading end (a front end) of the sheet P on which no printing has yet been implemented towards the inkjet heads 2 (the transport direction A). As shown by moderately thick white arrows in FIG. 3A, this air flow passes through the opening 41*b* and strikes the side wall 41*a* of the box 41 to thereby generate an upward air flow along the side wall 41*a*. This upward air flow passes between the side wall 41*a* and the inclined portion 41*g* and flows into an upper portion in the box 41, resulting in an air flow which flows in an opposite direction to the transport direction A. Thereafter, as indicated by moderately thick white arrows in FIG. 3B, the air flow flows in directions directed from a center of the box 41 towards the respective side walls 41*c*, 41*d* and escapes to an outside of the box 41 through the filters 51. As this occurs, paper dust carried by the air flow is captured by the filters 51, and paper dust so captured falls downwards from the filters 51 to thereby be held in the paper dust holding portion 42 when the air flow stops flowing (that is, as when the transport of the sheet P is stopped).

The electrostatic adsorption mechanism 43 has a chargeable roller 47 supported rotatably on the side walls 41*c*, 41*d* of the box 41 and a sponge member 48 fixed to the inclined portion 41*g*. As with the delivering roller 18, the chargeable roller 47 is made up of a metallic shaft 47*a* and a resin roller 47*b* having an easily chargeable surface such as a roller made from fluorine plastic or a roller whose surface is coated with fluorine, with the metallic shaft 47*a* covered by the resin roller 47*b*. The sponge member 48 is made from the same material as that of the sponge member 31 and is disposed below the chargeable roller 47 so as to be pressed against the chargeable roller 47. In this configuration, when a sheet P is transported in the transport direction A at high speed by the transport unit 20, in the event that the chargeable roller 47 is driven to rotate counterclockwise in FIG. 3A by a drive motor, an outer circumferential surface of the chargeable roller 47 is charged. Because of this, paper dust transported thereto by the upward air flow is then adsorbed to the chargeable roller 47. Paper dust adsorbed to the chargeable roller 47 is scraped thereoff by the sponge member 48 to thereby fall into the paper dust holding portion 42.

As with the auger member 34, the auger member 44 has a shaft 44*a* and two spiral members 44*b*, 44*c*. The shaft 44*a* extends in an up-down direction in FIG. 3B so as to pass through holes 54, 55 which are formed respectively in the side walls 41*c*, 41*d* of the box 41 and is rotatably supported, respectively, on side walls of the paper dust storage portions 45, 46 at both ends thereof. The spiral member 44*b* extends from a center of the shaft 44*a* into an interior of the paper dust storage portion 45 which is disposed upwards in FIG. 3B after passing through the hole 54, while the spiral member 44*c* extends from the center of the shaft 44*a* into an interior of the paper dust storage portion 46 which is disposed downwards in FIG. 3B after passing through the hole 55. In addition, the two spiral members 44*b*, 44*c* are spiraled in an opposite direction to each other. In this configuration, when the shaft 44*a* rotates counterclockwise in FIG. 3A, the spiral member 44*b* transports paper dust held in the paper dust holding portion 42 to the interior of the paper dust storage portion 45, while the spiral member 44*c* transports paper dust held in the paper dust holding portion 42 to the interior of the paper dust storage portion 46.

Thus, according to the inkjet printer 1 of the exemplary embodiment, since the box 41 is disposed further upstream than the inkjet head 2 which lies upstreammost in the transport direction A so as to lie adjacent to the upstreammost inkjet head 2, paper dust blown upwards by the upward air flow can be captured by the box 41. Because of this, paper dust is made difficult to enter in the vicinity of the discharge surface 2*a* of the inkjet head 2, whereby extraneous substances are made difficult to stick to the discharge surface 2*a*.

In addition, in the box 41, the opening 41*b* is formed in the position which confronts the transfer belt 23 and the paper holding portion 42 is formed in the interior thereof. Paper dust can also be captured by such a simple configuration. In addition, since the box 41 and the upstreammost inkjet head 2 are disposed in such a state that the downstream-side side wall 41*a* of the box 41 in the transport direction A is adjacent to the upstream-side side wall of the inkjet head 2 in the transport direction A, there is caused no gap therebetween. Because of this, paper dust can be captured with good efficiency. As a modified example, a configuration may be adopted in which the upstream-side side wall of the inkjet head 2 in the transport direction A constitutes the downstream-side side wall of the box. In this case, as with the case described above, there is caused no gap between the inkjet head 2 and the box, whereby paper dust can be captured with good efficiency.

Since the paper dust capture mechanism 40 has the auger member 44 and the paper storage portions 45, 46, even though a large amount of paper dust is captured by the box 41, paper dust so captured is made difficult to overflow from the paper dust holding portion 42. Since the paper capture mechanism 40 has the electrostatic adsorption mechanism 43, paper dust transported by the upward air flow can be capture in an ensured fashion.

Since the paper dust removal mechanism 30 for removing paper dust from a sheet P is provided upstream of the transport unit 20 in the transport direction A, paper dust on the sheet P can be removed separately from the paper dust capture mechanism 40. Because of this, paper dust is made difficult to enter in the vicinity of the discharge surface 2*a* of the inkjet head 2. Even through the hold-down roller 24 which holds down the sheet P against the transport surface 23*a* is disposed in the inkjet printer 1, the hold-down roller 24 is disposed further upstream in the transport direction A than the box 41. Therefore, even though paper dust is generated when the hold-down roller 24 is brought into contact with the sheet P, paper dust so generated can be captured by the box 41.

Figure 4:
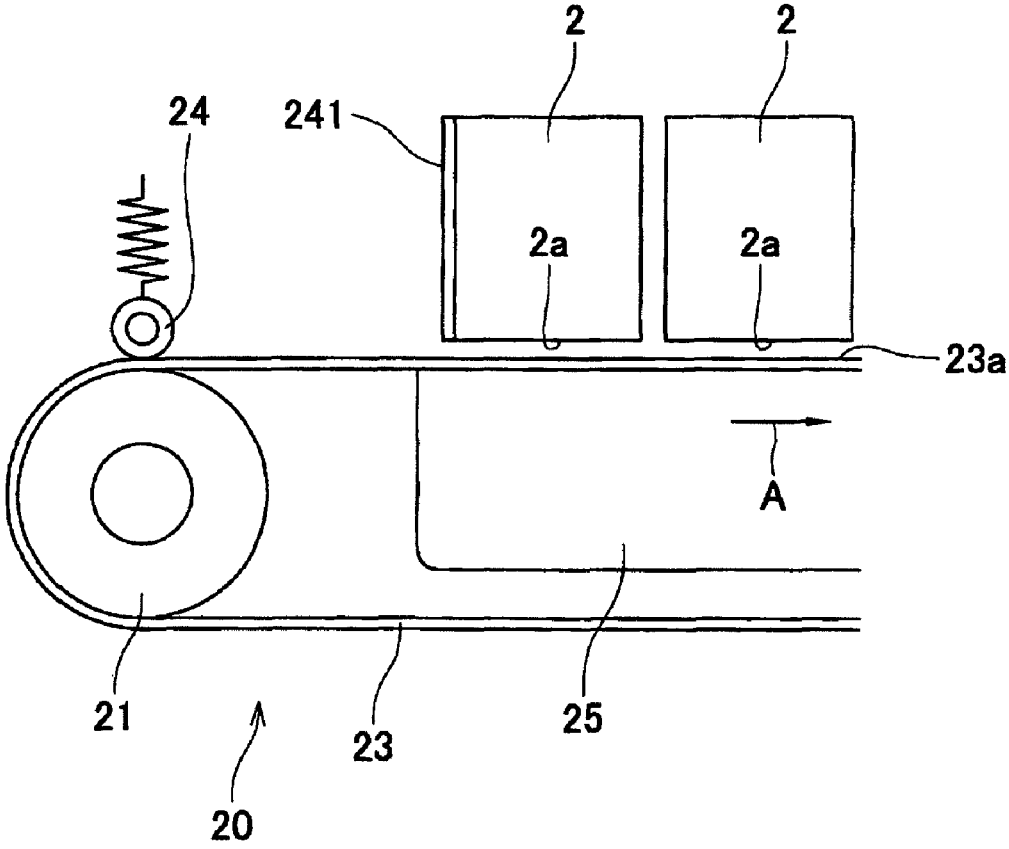
FIG. 4 is an enlarged view of a part of the inkjet printer according to the modified exemplary embodiment of the present invention.

As a modified exemplary embodiment, as shown in FIG. 4, in place of the paper dust capture mechanism 40, an adhesive member 241 may be glued to the upstream-side side wall of the inkjet head 2 which lies upstreammost in the transport direction A. This adhesive tape 241 is made up of a so-called pressure sensitive adhesive double coated tape in which adhesive layers are formed on both a side which contacts the upstream-side side wall of the upstreammost inkjet head 2 in the transport direction A and an opposite side thereto. In this modified exemplary embodiment, the adhesive member 241 has a size which covers the whole of the upstream-side side wall of the inkjet head 2. Also, in the configuration like this, since paper dust transported by the upward air flow can be captured by the adhesive member 241 in an ensured fashion, the same advantage as that described above can be obtained. In addition, as another modified exemplary embodiment, this adhesive member 241 may be glued to an inner surface of the side wall 41*a* of the box 41. By this configuration, it becomes possible to capture paper dust in a more ensured fashion.

In addition, in the exemplary embodiment, while the paper dust capture mechanism 40 is adopted in the in-line type inkjet printer in which when a sheet P is transported to the area where the sheet confronts the discharge surfaces 2*a* of the inkjet heads 2 by the transport unit 20, inks are discharged onto the sheet P so transported from the inkjet heads 2 which are fixed in the predetermined positions, the paper dust capture mechanism (the capture part) can also be applied to, for example, a serial type inkjet printer which has a moving mechanism for moving inkjet heads and in which inks are discharged onto a sheet from the moving inkjet heads. As this occurs, the paper capture mechanism only has to be disposed so as to lie adjacent to a downstream-side side wall in the moving direction of the downstreammost inkjet head and to move in the same direction together with the inkjet head. Namely, the paper dust capture mechanism only has to be disposed so as to lie in the position which is adjacent to an upstream-side side wall of the inkjet head and to move together with the inkjet head with respect to a relative movement direction of the sheet P relative to the inkjet heads which is a reverse direction to the moving direction of the inkjet heads. Also in this configuration, when the inkjet heads move in the moving direction, an upward air flow is generated along the downstream-side side wall of the downstreammost inkjet head in the moving direction, and paper dust carried by the upward air flow so generated can be captured by the paper dust capture mechanism so disposed in the same manner as the exemplary embodiment described above.

Thus, while the exemplary embodiment of the present invention has been described heretofore, the invention is not limited to the exemplary embodiment of the present invention described above but can be modified variously without departing from the scope of the claims of the invention. In the exemplary embodiment, while the paper dust removal mechanism 30 and the paper dust capture mechanism 40 are made to remove and capture paper dust, the mechanisms can also be made to capture extraneous substances such as dust other than paper dust. The box 41 may be disposed so as to allow a gap to be defined between the box 41 and the inkjet head 2. In addition, the paper dust capture mechanism 40 may not have the electrostatic adsorption mechanism 43, the auger member 44 and the paper dust storage portions 45, 46. Additionally, neither the hold-down roller 24 nor the paper dust removal mechanism 30 may be provided in the inkjet printer 1. In addition, the paper dust capture mechanism may have only the electrostatic adsorption mechanism 43. By this configuration, the configuration of the paper dust capture mechanism is made simple, and paper dust carried by the upward air flow can still be captured.

In addition, the transport unit (the moving mechanism) for transporting the sheet P may have, in place of the endless belt like the transport belt 23, a drum which rotates in a circumferential direction with a sheet P held onto a circumferential surface thereof so as to transport the sheet P and a platen which moves in the transport direction with a sheet P held onto a flat transport surface thereof. In short, any transport unit can be adopted, provided the transport unit is configured to transport a sheet P in a predetermined transport direction.

According to a first illustrative aspect of the exemplary embodiment, there is provided an inkjet recording apparatus including an inkjet head having a discharge surface in which discharge ports are formed for discharging ink, a moving mechanism for moving the inkjet head and a recording medium relative to each other, and a capture part disposed further upstream than the inkjet head with respect to a relative movement direction of a recording medium relative to the inkjet head in such a manner as to lie adjacent to the inkjet head for capturing an extraneous substance.

According to the first exemplary embodiment, since the extraneous substance is captured upstream of the inkjet head by the capture part, the extraneous substance is made difficult to enter an area lying in the vicinity of the discharge surface, whereby the extraneous substance is made difficult to stick to the discharge surface.

In the first exemplary embodiment, it is preferable that the capture part has a box in which an opening is formed in a position which confronts the recording medium and that the extraneous substance holding portion for holding the extraneous substance which has entered in the box from the opening is formed in the box. By this configuration, the configuration of the capture part is made simple.

In addition, as this occurs, the box may be disposed in such a state that a downstream-side side wall of the box is in contact with an upstream-side side wall of the inkjet head with respect to the relative movement direction. Additionally, as this occurs, a downstream-side side wall of the box may constitute an upstream-side side wall of the inkjet head with respect to the relative movement direction. By these configurations, since there is defined no gap between the box and the inkjet head, extraneous substances can be captured with good efficiency.

In addition, as this occurs, the inkjet recording apparatus may have an extraneous substance transport mechanism for transporting the extraneous substance held on the extraneous substance holding portion to an outside of the extraneous substance holding portion and an extraneous substance storage portion for storing an extraneous substance transported thereto by the extraneous substance transport mechanism. By this configuration, even though many extraneous substances are captured, the extraneous substances so captured are made difficult to overflow from the extraneous substance holding portion.

In addition, in the first exemplary embodiment, the capture part preferably has an electrostatic adsorption mechanism for adsorbing the extraneous substance. By this configuration, it becomes possible to ensure the capture of extraneous substances.

Additionally, in the first exemplary embodiment, the capture part preferably has an adhesive member for holding the extraneous substance. By this configuration, it becomes possible to ensure the capture of extraneous substances.

In addition, as this occurs, the adhesive member may be attached to the upstream-side side wall of the inkjet head with respect to the relative movement direction. By this configuration, the configuration of the capture part is made simpler.

Additionally, in the first exemplary embodiment, it is preferable that the moving mechanism transports a recording medium to a position where the recording medium confronts the discharge surface and that the inkjet recording apparatus includes further an extraneous substance removal mechanism disposed upstream of the moving mechanism with respect to a transport direction of a recording medium which is transported by the moving mechanism for removing the extraneous substance from the recording medium so transported. By these configurations, extraneous substances can be removed from a recording medium separately from the capture part. Because of this, extraneous substances are made more difficult to infiltrate the area lying in the vicinity of the discharge surface of the inkjet head.

In addition, in the first exemplary embodiment, the inkjet recording apparatus preferably includes further a roller disposed in a position where the roller holds the capture portion with the inkjet head therebetween and adapted to be brought into contact with a recording medium. By this configuration, even though the extraneous substance is generated when the roller is brought into contact with a recording medium, the extraneous substance is allowed to be captured by the capture part.

What is claimed is:

1. An inkjet recording apparatus comprising:

an inkjet head having a discharge surface in which discharge ports are formed for discharging ink;

a moving mechanism that is configured to move the inkjet head and a recording medium relative to each other; and a capture unit that is configured to capture an extraneous substance, the capture unit disposed upstream of the inkjet head in a moving direction of the recording medium relative to the inkjet head, and disposed adjacent to the inkjet head, wherein the capture unit comprises an electrostatic adsorption mechanism that is configured to adsorb the extraneous substance.

2. The inkjet recording apparatus according to claim 1, wherein the capture unit comprises a box in which an opening is formed in a position which confronts the recording medium, and wherein the box comprises an extraneous substance holding portion that is configured to hold the extraneous substance entering in the box from the opening.

3. The inkjet recording apparatus according to claim 2, wherein a downstream side wall of the box is in contact with an upstream side wall of the inkjet head in the moving direction.

4. The inkjet recording apparatus according to claim 2, wherein a downstream side wall of the box also constitutes an upstream-side side wall of the inkjet head in the moving direction.

5. The inkjet recording apparatus according to claim 2, wherein the capture unit further comprises:

an extraneous substance transport mechanism that is configured to transport the extraneous substance held on the extraneous substance holding portion to an outside of the extraneous substance holding portion; and an extraneous substance storage portion that is configured to store the extraneous substance transported by the extraneous substance transport mechanism.

6. The inkjet recording apparatus according to claim 1, wherein the moving mechanism transports the recording medium to a position where the recording medium confronts the discharge surface along a transport direction of the recording medium, and the inkjet recording apparatus further comprises:

an extraneous substance removal mechanism that is disposed upstream of the moving mechanism in the transport direction of the recording medium which is transported by the moving mechanism, the extraneous substance removal mechanism configured to remove the extraneous substance from the recording medium that is transported.

7. The inkjet recording apparatus according to claim 1, further comprising:

a roller that is disposed in a position between the capture unit and the inkjet head, the roller configured to be brought into contact with the recording medium.

8. An inkjet recording apparatus comprising:

an inkjet head having a discharge surface in which discharge ports are formed for discharging ink;

a moving mechanism that is configured to move the inkjet head and a recording medium relative to each other; and a capture unit that is configured to capture an extraneous substance, the capture unit disposed upstream of the inkjet head in a moving direction of the recording medium relative to the inkjet head, and disposed adjacent to the inkjet head, wherein the capture unit comprises an adhesive member that is configured to hold the extraneous substance.

9. The inkjet recording apparatus according to claim 8, wherein the adhesive member is attached to an upstream side wall of the inkjet head in the moving direction.

10. The inkjet recording apparatus according to claim 8, further comprising:

a roller that is disposed in a position between the capture unit and the inkjet head, the roller configured to be brought into contact with the recording medium.

11. The inkjet recording apparatus according to claim 8, wherein the capture unit comprises a box in which an opening is formed in a position which confronts the recording medium, and wherein the box comprises an extraneous substance holding portion that is configured to hold the extraneous substance entering in the box from the opening.

12. The inkjet recording apparatus according to claim 11, wherein a downstream side wall of the box is in contact with an upstream side wall of the inkjet head in the moving direction.

13. The inkjet recording apparatus according to claim 11, wherein a downstream side wall of the box also constitutes an upstream-side side wall of the inkjet head in the moving direction.

14. The inkjet recording apparatus according to claim 11, wherein the capture unit further comprises:

an extraneous substance transport mechanism that is configured to transport the extraneous substance held on the extraneous substance holding portion to an outside of the extraneous substance holding portion; and an extraneous substance storage portion that is configured to store the extraneous substance transported by the extraneous substance transport mechanism.

15. The inkjet recording apparatus according to claim 8, wherein the moving mechanism transports the recording medium to a position where the recording medium confronts the discharge surface along a transport direction of the recording medium, and wherein the inkjet recording apparatus further comprises:

an extraneous substance removal mechanism that is disposed upstream of the moving mechanism in the transport direction of the recording medium which is transported by the moving mechanism, the extraneous substance removal mechanism configured to remove the extraneous substance from the recording medium that is transported.

* * * * *